US007452285B2

(12) United States Patent
Chao et al.

(10) Patent No.: US 7,452,285 B2
(45) **Date of Patent: *Nov. 18, 2008**

(54) WEIGHT KIT FOR GOLF CLUB HEAD

(75) Inventors: Bing-Ling Chao, San Diego, CA (US); Brian Weed, San Diego, CA (US); Kraig A. Willett, Fallbrook, CA (US); Joseph H. Hoffman, Carlsbad, CA (US); Gery Zimmerman, Fallbrook, CA (US); Benoit Vincent, Encinitas, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/647,797

(22) Filed: Dec. 28, 2006

(65) Prior Publication Data

US 2007/0111817 A1 May 17, 2007

Related U.S. Application Data

(63) Continuation of application No. 10/785,692, filed on Feb. 23, 2004, now Pat. No. 7,166,040, which is a continuation-in-part of application No. 10/290,817, filed on Nov. 8, 2002, now Pat. No. 6,773,360.

(51) Int. Cl.
*A63B 53/04* (2006.01)

(52) U.S. Cl. ..... 473/324; 473/334; 473/338; 473/345; 473/349; 473/409; 473/407

(58) Field of Classification Search ..... 473/324–350, 473/287–292, 219–256, 407, 409
See application file for complete search history.

(56) References Cited

U.S. PATENT DOCUMENTS 1,167,106 A 1/1916 Palmer (Continued)

FOREIGN PATENT DOCUMENTS

DE 9012884 1/1991

(Continued)

OTHER PUBLICATIONS

Jackson, Jeff, The Modern Guide To Golf Clubmaking. Ohio: Dynacraft Golf Products, Inc., copyright 1994, p. 237.

*Primary Examiner*—Sebastiano Passaniti
(74) *Attorney, Agent, or Firm*—Sheppard, Mullin, Richter & Hampton

(57) ABSTRACT

Individual weights and a related kit for adjustably weighting a golf club head are provided, allowing a golfer to fine-tune the club for his or her swing. The kit is useable with a club head that defines a plurality of weight recesses spaced about the club head. The kit includes a plurality of weights, including weights of different mass. Each weight is sized to be threadably received within a recess of the club head. Varying placement of the weights enables a golfer to vary impact conditions in the club head, for optimum distance and accuracy. The kit may further include a tool having an engagement end configured to operatively mate with the fasteners of the weights. The tool preferably includes a torque limiting mechanism configured to inhibit over-tightening of the weights into the recess of the club head. The tool and weights may be provided along with the golf club. The kit may also include instructions, such as an instruction wheel, for selecting and positioning weights of the plurality of weight about the club head.

19 Claims, 5 Drawing Sheets

U.S. PATENT DOCUMENTS

| | | | | | |
|---|---|---|---|---|---|
| 1,213,382 | A | | 1/1917 | Kent | |
| 1,453,503 | A | | 5/1923 | Holmes | |
| 1,518,316 | A | | 12/1924 | Ellingham | |
| 1,526,438 | A | | 2/1925 | Scott | |
| 1,538,312 | A | | 5/1925 | Beat | |
| 1,568,888 | A | | 1/1926 | Dunn | |
| 1,592,463 | A | | 7/1926 | Marker | |
| 1,658,581 | A | | 2/1928 | Tobia | |
| 1,704,119 | A | | 3/1929 | Buhrke | |
| 1,756,219 | A | | 4/1930 | Spiker | |
| 1,868,286 | A | | 7/1932 | Grieve | |
| 1,970,409 | A | | 8/1934 | Wiedemann | |
| 2,067,556 | A | | 1/1937 | Wettlaufer | |
| D107,007 | S | | 11/1937 | Cashmore | |
| 2,163,091 | A | | 6/1939 | Held | |
| 2,171,383 | A | | 8/1939 | Wettlaufer | |
| 2,198,981 | A | | 4/1940 | Sullivan | |
| 2,214,356 | A | | 9/1940 | Wettlaufer | |
| 2,225,930 | A | | 12/1940 | Sexton | |
| 2,328,583 | A | | 9/1943 | Reach | |
| 2,332,342 | A | | 10/1943 | Reach | |
| 2,360,364 | A | | 10/1944 | Reach | |
| 2,460,435 | A | | 2/1949 | Schaffer | |
| 2,460,445 | A | | 2/1949 | Bigler | |
| 2,681,523 | A | | 6/1954 | Sellers | |
| 2,998,254 | A | | 8/1961 | Rains et al. | |
| 3,064,980 | A | | 11/1962 | Steiner | |
| 3,075,768 | A | | 1/1963 | Karns | |
| 3,106,030 | A | * | 10/1963 | Pelosi | 40/495 |
| 3,143,349 | A | | 8/1964 | MacIntyre | |
| 3,277,591 | A | | 10/1966 | Rutkofsky | |
| 3,309,017 | A | | 3/1967 | Koskela | |
| 3,363,836 | A | | 1/1968 | Lee | |
| 3,466,047 | A | | 9/1969 | Rodin et al. | |
| 3,556,533 | A | * | 1/1971 | Hollis | 473/338 |
| 3,589,731 | A | | 6/1971 | Chancellor, Jr. | |
| 3,606,327 | A | | 9/1971 | Gorman | |
| 3,610,630 | A | | 10/1971 | Glover | |
| 3,652,094 | A | | 3/1972 | Glover | |
| 3,672,419 | A | | 6/1972 | Fischer | |
| 3,680,868 | A | | 8/1972 | Jacob | |
| 3,692,306 | A | | 9/1972 | Glover | |
| 3,743,297 | A | | 7/1973 | Dennis | |
| 3,744,714 | A | | 7/1973 | Banner | |
| 3,749,408 | A | | 7/1973 | Mills | |
| 3,897,066 | A | | 7/1975 | Belmont | |
| 3,976,299 | A | | 8/1976 | Lawrence et al. | |
| 3,979,122 | A | | 9/1976 | Belmont | |
| 3,979,123 | A | | 9/1976 | Belmont | |
| 4,008,896 | A | | 2/1977 | Gordos | |
| 4,043,563 | A | * | 8/1977 | Churchward | 473/338 |
| 4,052,075 | A | | 10/1977 | Daly | |
| 4,076,254 | A | | 2/1978 | Nygren | |
| 4,085,934 | A | | 4/1978 | Churchward | |
| 4,121,832 | A | | 10/1978 | Ebbing | |
| 4,180,269 | A | | 12/1979 | Thompson | |
| 4,214,754 | A | | 7/1980 | Zebelean | |
| 4,262,562 | A | | 4/1981 | MacNeill | |
| D259,698 | S | | 6/1981 | MacNeill | |
| 4,325,553 | A | | 4/1982 | Taylor | |
| 4,340,229 | A | | 7/1982 | Stuff, Jr. | |
| 4,340,230 | A | | 7/1982 | Churchward | |
| 4,411,430 | A | | 10/1983 | Dian | |
| 4,417,731 | A | | 11/1983 | Yamada | |
| 4,423,874 | A | | 1/1984 | Stuff, Jr. | |
| 4,432,549 | A | | 2/1984 | Zebelean | |
| 4,438,931 | A | | 3/1984 | Motomiya | |
| 4,502,687 | A | | 3/1985 | Kochevar | |
| 4,530,505 | A | | 7/1985 | Stuff | |
| D284,346 | S | | 6/1986 | Masters | |
| 4,602,787 | A | | 7/1986 | Sugioka et al. | |
| 4,607,846 | A | | 8/1986 | Perkins | |
| 4,655,459 | A | | 4/1987 | Antonious | |
| 4,730,830 | A | | 3/1988 | Tilley | |
| 4,736,093 | A | | 4/1988 | Braly | |
| 4,754,977 | A | | 7/1988 | Sahm | |
| 4,795,159 | A | | 1/1989 | Nagamoto | |
| 4,811,950 | A | | 3/1989 | Kobayaskhi | |
| 4,824,116 | A | | 4/1989 | Nagamoto et al. | |
| 4,867,458 | A | | 9/1989 | Sumikawa et al. | |
| 4,869,507 | A | | 9/1989 | Sahm | |
| 4,895,371 | A | | 1/1990 | Bushner | |
| 4,927,144 | A | | 5/1990 | Stormon | |
| 4,944,515 | A | | 7/1990 | Shearer | |
| 4,962,932 | A | | 10/1990 | Anderson | |
| 4,994,515 | A | | 2/1991 | Washiyama et al. | |
| 5,013,041 | A | | 5/1991 | Sun et al. | |
| 5,039,267 | A | | 8/1991 | Wollar | |
| 5,050,879 | A | | 9/1991 | Sun et al. | |
| 5,056,705 | A | | 10/1991 | Wakita et al. | |
| 5,058,895 | A | | 10/1991 | Igarashi | |
| 5,078,400 | A | | 1/1992 | Desbiolles et al. | |
| 5,082,278 | A | | 1/1992 | Hsien | |
| 5,184,823 | A | | 2/1993 | Desboilles et al. | |
| 5,193,806 | A | | 3/1993 | Burkly | |
| 5,219,408 | A | | 6/1993 | Sun | |
| 5,244,210 | A | | 9/1993 | Au | |
| 5,253,869 | A | | 10/1993 | Dingle et al. | |
| 5,273,283 | A | | 12/1993 | Bowland | |
| D343,558 | S | | 1/1994 | Latraverse et al. | |
| 5,289,865 | A | | 3/1994 | Sun | |
| 5,291,850 | A | | 3/1994 | Gries et al. | |
| 5,316,298 | A | | 5/1994 | Hutin et al. | |
| 5,316,305 | A | | 5/1994 | McCabe | |
| 5,320,005 | A | | 6/1994 | Hsiao | |
| 5,322,285 | A | | 6/1994 | Turner | |
| 5,328,176 | A | | 7/1994 | Lo | |
| 5,351,958 | A | | 10/1994 | Helmstetter | |
| 5,385,348 | A | | 1/1995 | Wargo | |
| 5,407,202 | A | | 4/1995 | Igarashi | |
| 5,410,798 | A | | 5/1995 | Lo | |
| 5,421,577 | A | | 6/1995 | Kobayashi | |
| 5,429,365 | A | | 7/1995 | McKeighen | |
| 5,439,222 | A | | 8/1995 | Kranenberg | |
| 5,441,274 | A | | 8/1995 | Clay | |
| 5,447,309 | A | * | 9/1995 | Vincent | 473/345 |
| 5,481,093 | A | | 1/1996 | Rogerson | |
| 5,482,282 | A | | 1/1996 | Willis | |
| 5,518,243 | A | * | 5/1996 | Redman | 473/334 |
| 5,522,593 | A | | 6/1996 | Kobayashi et al. | |
| 5,533,730 | A | | 7/1996 | Ruvang | |
| 5,558,226 | A | | 9/1996 | Fritz | |
| 5,570,886 | A | | 11/1996 | Rigal et al. | |
| 5,571,053 | A | | 11/1996 | Lane | |
| 5,603,499 | A | | 2/1997 | Jagosz | |
| 5,624,331 | A | | 4/1997 | Lo et al. | |
| 5,629,475 | A | | 5/1997 | Chastonay | |
| 5,632,694 | A | | 5/1997 | Lee | |
| 5,669,827 | A | | 9/1997 | Nagamoto | |
| 5,683,309 | A | | 11/1997 | Reimers | |
| 5,709,613 | A | | 1/1998 | Sheraw | |
| 5,718,641 | A | | 2/1998 | Lin | |
| D392,526 | S | | 3/1998 | Nicely | |
| 5,746,664 | A | | 5/1998 | Reynolds, Jr. | |
| 5,755,624 | A | | 5/1998 | Yamazaki et al. | |
| 5,755,627 | A | | 5/1998 | Yamazaki et al. | |
| 5,766,092 | A | | 6/1998 | Mimeur et al. | |
| 5,769,737 | A | | 6/1998 | Holladay et al. | |
| 5,776,011 | A | | 7/1998 | Su et al. | |
| 5,797,807 | A | | 8/1998 | Moore | |
| RE35,955 | E | | 11/1998 | Lu | |
| 5,851,160 | A | | 12/1998 | Rugge et al. | |
| 5,855,525 | A | | 1/1999 | Turner | |
| D409,463 | S | | 5/1999 | McMullin | |

| | | | | |
|---|---|---|---|---|
| 5,908,356 | A | 6/1999 | Nagamoto | |
| 5,911,638 | A | 6/1999 | Parente et al. | |
| 5,913,735 | A | 6/1999 | Kenmi | |
| D412,547 | S | 8/1999 | Fong | |
| 5,935,019 | A | 8/1999 | Yamamoto | |
| 5,941,782 | A | 8/1999 | Cook | |
| 5,947,840 | A * | 9/1999 | Ryan | 473/335 |
| 5,961,394 | A | 10/1999 | Minabe | |
| 5,967,905 | A | 10/1999 | Nakahara et al. | |
| 5,997,415 | A | 12/1999 | Wood | |
| 6,001,024 | A | 12/1999 | Van Alen, II et al. | |
| 6,015,354 | A | 1/2000 | Ahn et al. | |
| 6,019,686 | A | 2/2000 | Gray | |
| 6,023,891 | A | 2/2000 | Robertson et al. | |
| 6,030,295 | A | 2/2000 | Takeda | |
| 6,032,677 | A | 3/2000 | Blechman et al. | |
| 6,056,649 | A | 5/2000 | Imai | |
| 6,089,994 | A | 7/2000 | Sun | |
| 6,149,533 | A | 11/2000 | Finn | |
| 6,162,133 | A | 12/2000 | Peterson | |
| 6,254,494 | B1 | 2/2001 | Hasebe et al. | |
| 6,206,790 | B1 | 3/2001 | Kubica et al. | |
| 6,238,303 | B1 * | 5/2001 | Fite | 473/342 |
| 6,248,025 | B1 | 6/2001 | Murphy et al. | |
| 6,270,422 | B1 | 8/2001 | Fisher | |
| 6,277,032 | B1 | 8/2001 | Smith | |
| 6,290,609 | B1 | 9/2001 | Takeda | |
| 6,296,579 | B1 | 10/2001 | Robinson | |
| 6,299,547 | B1 | 10/2001 | Kosmatka | |
| 6,306,048 | B1 | 10/2001 | McCabe et al. | |
| 6,309,311 | B1 | 10/2001 | Lu | |
| 6,315,678 | B1 | 11/2001 | Teramoto | |
| 6,334,817 | B1 | 1/2002 | Ezawa et al. | |
| 6,348,014 | B1 | 2/2002 | Chiu | |
| 6,364,788 | B1 | 4/2002 | Helmstetter et al. | |
| 6,379,265 | B1 | 4/2002 | Hirakawa et al. | |
| 6,383,090 | B1 | 5/2002 | O'Doherty et al. | |
| 6,390,933 | B1 | 5/2002 | Galloway et al. | |
| 6,409,612 | B1 | 6/2002 | Evans et al. | |
| 6,436,142 | B1 | 8/2002 | Paes et al. | |
| 6,440,009 | B1 | 8/2002 | Guibaud et al. | |
| 6,443,851 | B1 | 9/2002 | Liberatore | |
| 6,458,044 | B1 | 10/2002 | Vincent et al. | |
| 6,514,154 | B1 | 2/2003 | Finn | |
| 6,524,197 | B2 | 2/2003 | Boone | |
| 6,527,649 | B1 | 3/2003 | Neher et al. | |
| 6,530,848 | B2 | 3/2003 | Gillig | |
| 6,565,448 | B2 | 5/2003 | Cameron et al. | |
| 6,569,040 | B2 | 5/2003 | Bradstock | |
| 6,641,487 | B1 | 11/2003 | Hamburger | |
| 6,669,571 | B1 | 12/2003 | Cameron et al. | |
| 6,739,983 | B2 | 5/2004 | Helmstetter et al. | |
| 6,757,572 | B1 | 6/2004 | Forest | |
| 6,773,360 | B2 | 8/2004 | Willett et al. | |
| 6,974,393 | B2 | 12/2005 | Caldwell et al. | |
| 6,988,960 | B2 | 1/2006 | Mahaffey et al. | |
| 6,991,558 | B2 * | 1/2006 | Beach et al. | 473/324 |
| 7,140,974 | B2 | 11/2006 | Chao et al. | |
| 7,153,220 | B2 * | 12/2006 | Lo | 473/335 |
| 7,163,468 | B2 | 1/2007 | Gibbs et al. | |
| 7,166,040 | B2 * | 1/2007 | Hoffman et al. | 473/334 |
| 7,169,060 | B2 | 1/2007 | Stevens et al. | |
| 7,186,190 | B1 | 3/2007 | Beach et al. | |
| 2001/0049310 | A1 | 12/2001 | Cheng et al. | |
| 2002/0022535 | A1 | 2/2002 | Takeda | |
| 2002/0032075 | A1 * | 3/2002 | Vatsvog | 473/334 |
| 2002/0072434 | A1 | 6/2002 | Yabu | |
| 2002/0137576 | A1 | 9/2002 | Dammen | |
| 2002/0160854 | A1 | 10/2002 | Beach et al. | |
| 2003/0130059 | A1 | 7/2003 | Billings | |
| 2004/0087388 | A1 | 5/2004 | Beach et al. | |
| 2004/0242343 | A1 | 12/2004 | Chao et al. | |
| 2006/0058112 | A1 * | 3/2006 | Haralason et al. | 473/334 |

FOREIGN PATENT DOCUMENTS

| | | |
|---|---|---|
| EP | 1001175 | 5/2000 |
| GB | 194823 | 3/1923 |
| JP | 05317465 | 12/1993 |
| JP | 06-126004 | 5/1994 |
| JP | 06304271 | 11/1994 |
| JP | 09-28844 | 2/1997 |
| JP | 09308717 | 12/1997 |
| JP | 09327534 | 12/1997 |
| JP | 10234902 | 9/1998 |
| JP | 10-277187 | 10/1998 |
| JP | 2004-222911 | 8/2004 |
| WO | WO 8802642 | 4/1988 |
| WO | WO 01/66199 | 9/2001 |
| WO | WO 02062501 | 8/2002 |
| WO | WO 03/061773 | 7/2003 |

* cited by examiner

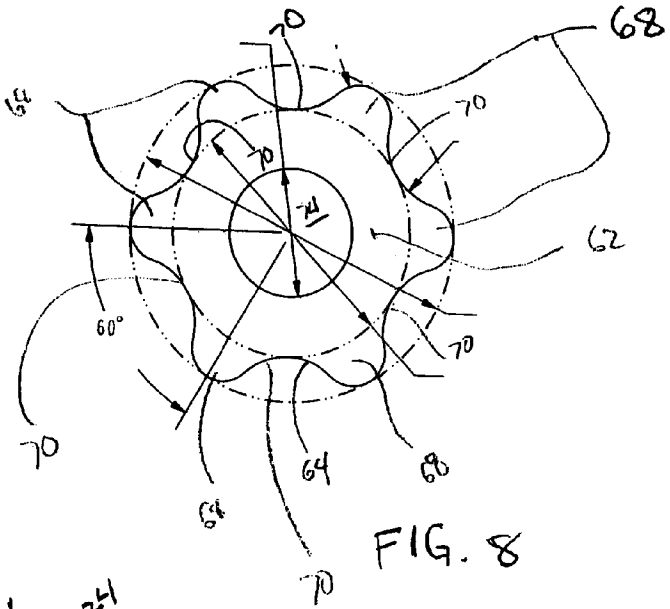
FIG. 8
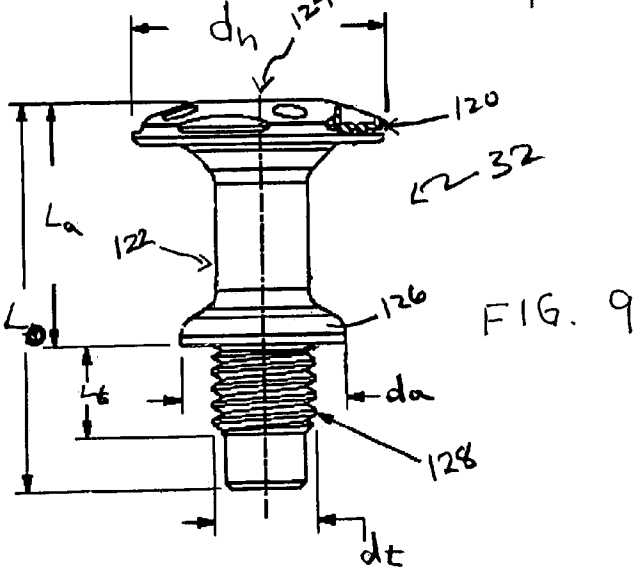
120
122
122
122

WEIGHT KIT FOR GOLF CLUB HEAD

CROSS REFERENCE TO RELATED APPLICATION

This is a continuation of prior application Ser. No. 10/785,692, filed Feb. 23, 2004, now U.S. Pat. No. 7,166,040 which is a continuation-in-part of U.S. patent application Ser. No. 10/290,817, filed Nov. 8, 2002, now U.S. Pat. No. 6,773,360, which is herein incorporated by reference.

FIELD OF THE INVENTION

The present invention relates generally to golf clubs and, more particularly, to removable weights and related kits of golf club heads.

BACKGROUND OF THE INVENTION

The center of gravity of a golf club head is a critical parameter of the club's performance. Upon impact, it greatly affects launch angle and flight trajectory of a golf ball. Thus, much effort has been made into positioning a club head's the center of gravity. To that end, current driver and fairway wood golf club heads are typically formed of lightweight, yet durable material, such as steel or titanium alloys. These materials are typically used to form thin club head walls. With such walls, the designer is allowed more leeway in assigning club mass to achieve desired mass distribution.

Various approaches for have been implemented for position discretionary mass about a golf club head. Many club heads have integral sole weight pads cast into the head at a predetermined location to lower the club head's center of gravity. Also, epoxy may be later added through the club head's hosel opening to obtain a final desired weight of the club head. To achieve significant localized mass, weights formed of high-density material have been attached to the sole. With these weights, the method of installation is critical because the club head endures significant loads at impact with a golf ball, which can dislodge the weight. Thus, such weights typically are permanently attached and are limited in total mass. This, of course, permanently fixes the club head's center of gravity.

Golf swings vary among golfers. However, a club head's weighting typically is set for a standard, or ideal, swing type. Thus, even though the weight may be too light or too heavy, or too far forward or too far rearward, the golfer cannot adjust or customize the club weighting to his or her particular swing. Rather, golfers often must test a number of different types of golf clubs to find one that is suited for them. Even this approach may not provide a golf club with an optimum weight and center of gravity, let alone the possibility of switching from one performance configuration to another, and back again.

It should, therefore, be appreciated that there is a need for an approach for adjustably weighting a golf club head that allows a golfer to fine-tune the club head for his or her swing. The present invention fulfills this need and others.

SUMMARY OF THE INVENTION

Briefly, and in general terms, the invention provides removable weight and a related kit for adjustably weighting a golf club head, allowing the golfer to fine-tune the club head for his or her swing. The weights are preferably used with a club head that defines a plurality of weight recesses spaced about the club head, in which a wall of each recess defines a threaded opening. Each weight includes a threaded fastener and is configured to be threadably received within a separate recess of the club head. Moreover, the weight is configured to endure impact loads without dislodging. The related kit includes a plurality of weights, including weights of different mass. Varying placement of the weights enables a golfer to vary impact conditions in the club head, for optimum distance and accuracy.

More specifically, and by way of example, the kit may further include a tool having an engagement end configured to operatively mate with the fasteners of the weights. The tool preferably includes a torque-limiting mechanism to inhibit over-tightening of the weights into the recess of the club head. The tool and weights may be provided along with the golf club. The kit may also include instructions for selecting and positioning weights of the plurality of weight about the club head.

In a detailed aspect of an exemplary embodiment, the kit includes an instruction wheel configured to provide instructions for selecting and positioning weights of the plurality of weight about the club head. The instruction wheel has a top member and a bottom member rotatably mounted to each other. The top member having a graphical representation of the club head, including windows located at weight recess positions on the club head. The bottom member having groupings of weight icons positioned about the bottom member. Each grouping corresponds to a prescribed weight configuration for the club head and is positioned to be viewable through the windows upon proper rotational alignment of the top and bottom members.

In another exemplary embodiment of the invention, a weight having a fastener, a mass element and a retaining cap is provided. The mass element defines a bore sized to allow a threaded body of the fastener to extend out the lower end of the mass element, while inhibiting a head of the fastener from passing through the bore. The retaining cap is attached to an upper end of the mass element such that the head of the corresponding fastener is captured therebetween. The retaining element defines an aperture aligned with the socket of the corresponding fastener to facilitate use of the tool. The weight can also be included as one of the plurality of weights of a kit.

In a detailed aspect of an exemplary embodiment, the bore of the mass element includes a lower portion and an upper portion. The lower portion is sized to freely receive the body of the fastener while not allowing the head of fastener to pass, and the upper portion of the bore is sized to allow the head of the screw to rest therein. The upper portion of the bore and the retaining element are configured to threadably mate with each other such that the head of the fastener is captured between the mass element and the retaining element.

In another detailed aspect of an exemplary embodiment, the engagement end of the wrench includes a multi-lobular side wall and an end wall defining an axial recess. The socket of each fastener includes an axial post aligned to be received by the axial recess of the wrench and is configured to operatively mate with the engagement end of the tool.

In yet another embodiment, a weight having a total mass between about 1 gram and about 2 grams is provided. The weight has a head that defines a socket for receiving an engagement end of a tool and that is configured to substantially conform to the recess of the club head. The weight also has a threaded body extending from the head and configured to cooperatively engage the threaded opening of the club head. In an exemplary embodiment, the threaded body has a diameter of about 5 mm. The threaded body can also have an annular ledge located in an intermediate region thereof, wherein the annular ledge has a diameter greater than that of a threaded portion of the body. In a detailed aspect, the weight a can have a thread configuration of M5×0.8.

For purposes of summarizing the invention and the advantages achieved over the prior art, certain advantages of the invention have been described herein above. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment disclosed.

BRIEF DESCRIPTION OF THE DRAWINGS

Embodiments of the present invention will now be described, by way of example only, with reference to the following drawings in which:

FIG. 7 is a perspective view of the tool of the kit of FIG. 1, depicting a grip and a tip.

FIG. 8 is a close-up plan view of the tip of the tool of FIG. 7.

FIG. 9 is a side elevational view of a weight screw of the kit of FIG. 1.

DETAILED DESCRIPTION OF THE PREFERRED EMBODIMENTS

Figure 1:
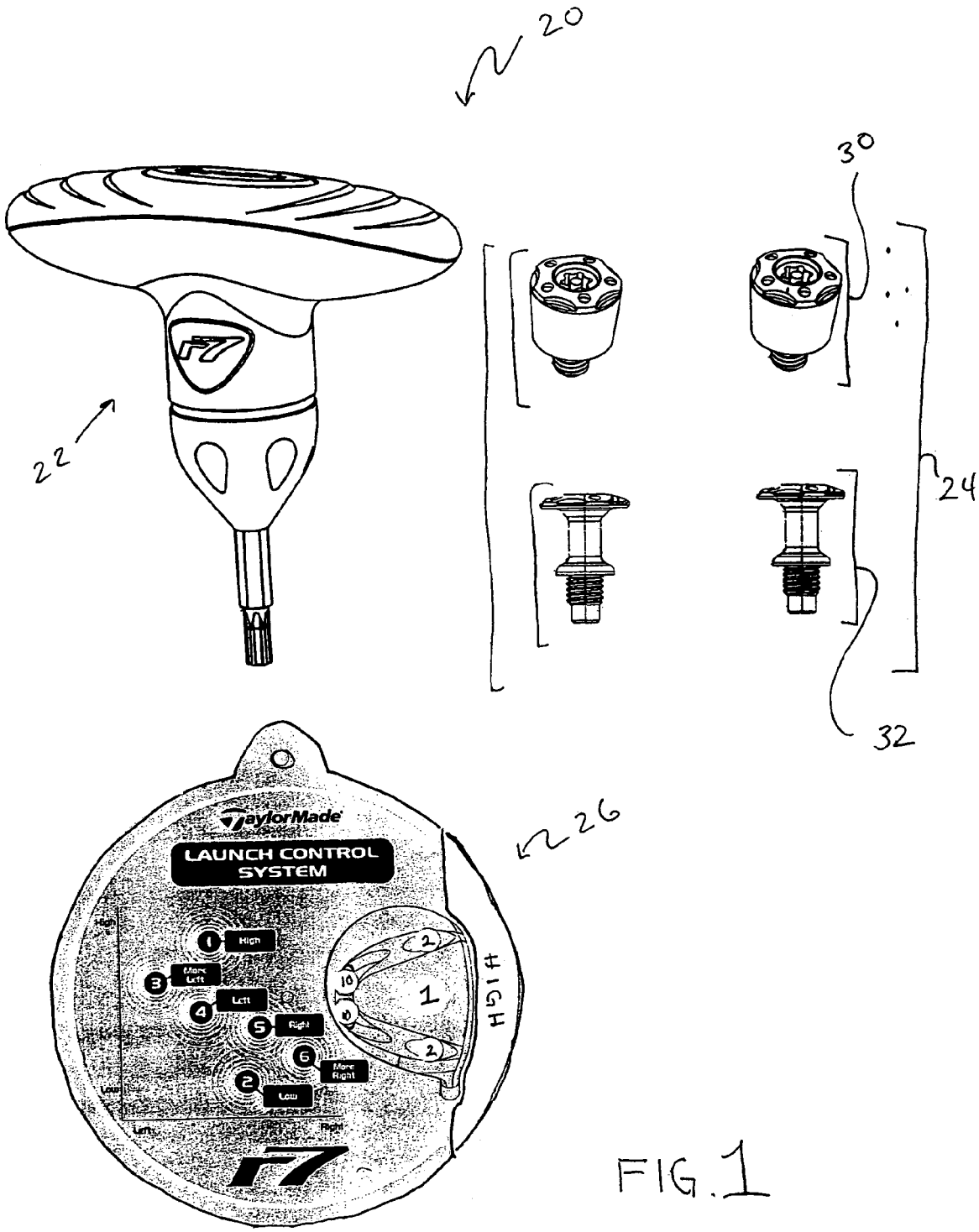
FIG. 1 is a perspective view of an embodiment of a kit for adjustably weighting a golf club head in accordance with the invention

Now with reference to the illustrative drawing, and particularly FIG. 1, there is shown a kit 20 having a driving tool, i.e., torque wrench 22, and a set of weights 24 usable with a golf club head having conforming recesses, and an instruction wheel 26. An exemplary club head 28 includes four recesses 96, 98, 102, 104 about periphery of the club head (FIGS. 2-5). In the exemplary embodiment, four weights are provided; two weight assemblies 30 of about 10 grams and two weight screws 32 of about 2 grams. Varying placement of the weights enables the golfer to vary launch conditions in the club head, for optimum distance and accuracy. More specifically, the golfer can adjust the position of the club head's center of gravity, for greater control over the characteristics of launch conditions and, therefore, the trajectory of the golf ball.

With reference to FIGS. 1-5, the weights 24 are sized to be securely received in any of the four recesses 96, 98, 102, 104 of the club head 28, and are secured in place using the torque wrench 22. The instruction wheel 26 aids the golfer in selected a proper weight configuration of achieving a desired effect to the trajectory of the golf shot. The kit 20 provides six different weight configurations for the club head, which provides substantially flexibility in positioning the center of gravity (CG) for the club head. In the exemplary embodiment, the CG of the club head can be adjustably located in an area adjacent to the sole having a length of about five millimeters measured from front-to-rear and width of about five millimeters measured from toe-to-heel. Each configuration delivers different launch conditions, including launch angle, spin-rate and the club head's alignment at impact, as discussed in detail below.

The weight assemblies 30 (FIG. 6) includes a mass element 34, a fastener, e.g., a screw 36, and a retaining cap 40. In the exemplary embodiment, the weight assemblies are preassembled; however, component parts can be provided for assembly by the user. For weights having a total mass between about 1 gram and about 2 grams, e.g., weights 32, a screw without a mass element preferably are used. Such weight screws can be formed of stainless steel, and the head of the screw preferably has a diameter sized to conform to any of the four recesses of the club head.

The kit 20 can be provided with the golf club at purchase, or sold separately. For example, golf club can be sold with the torque wrench 22, the instruction wheel 26, and the weights (e.g., two 10-gram weights 30 and two 2-gram weights 32) preinstalled. Kits having an even greater variety of weights can also be provided with the club, or sold separately. In another embodiment, a kit having eight weight assemblies is contemplated, e.g., a 2-gram weight, four 6-gram weights, two 14-gram weights, and an 18-gram weight. Such a kit may be particularly effective for golfers with a fairly consistent swing, by providing additional precision in weighting the club head. Also, weights in prescribed increments across a broad range can be available. For example, weights in one gram increments ranging from 1 gram to 25 grams can provide very precise weighting, which would be particularly advantageous for advanced and professional golfers. In such embodiments, weight assemblies ranging between 5 grams and 10 grams preferably use a mass element comprising primarily a titanium alloy. For weight assemblies from 10 grams to over 25 grams, a mass element comprising a tungsten-based alloy, or blended tungsten alloys, preferably are used. Other materials, or combinations thereof, can be used to achieve a desired weight. However, material selection should consider other requirements such as durability, size restraints, and removability.

Instruction Wheel

Figure 6:
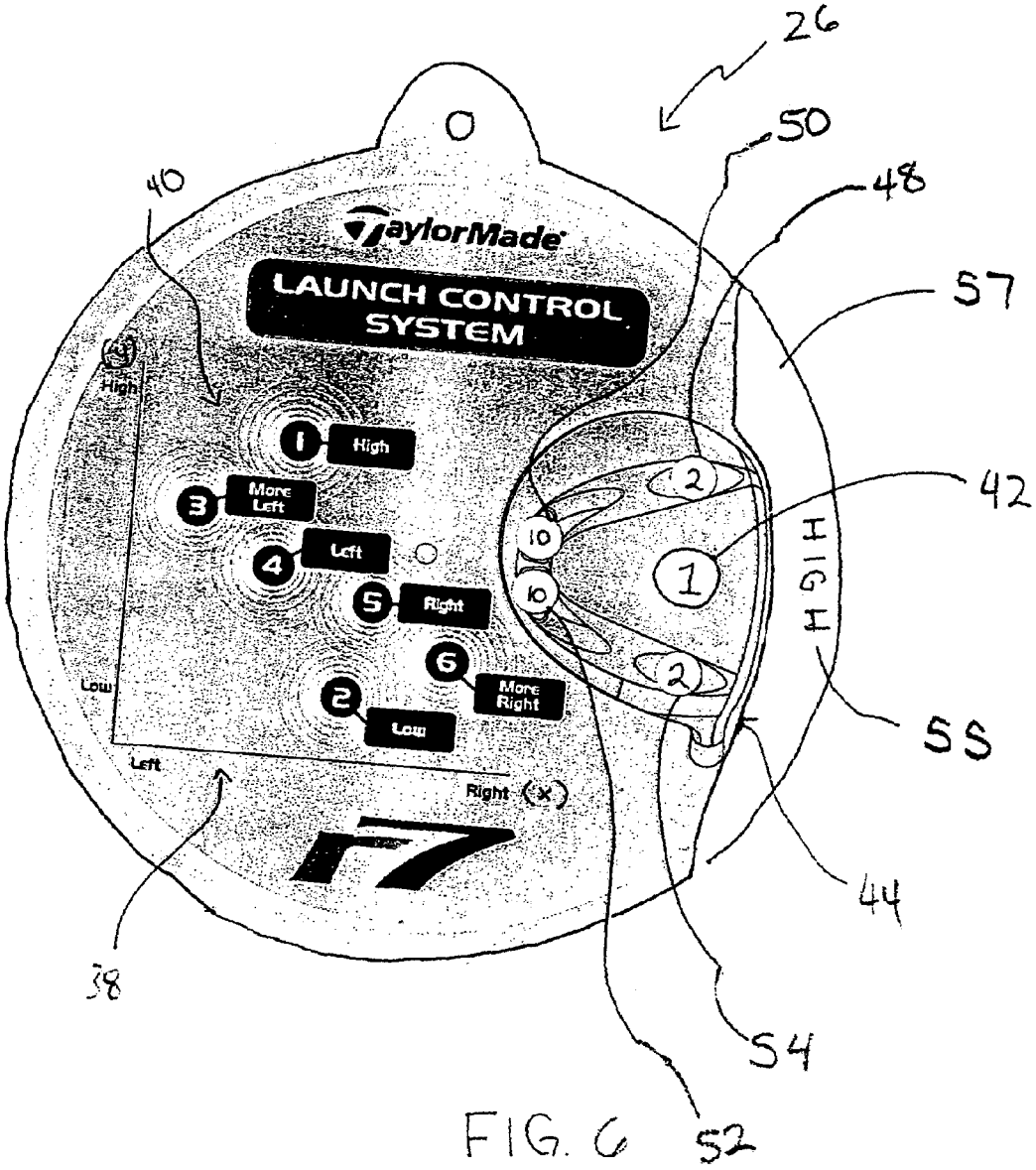
FIG. 6 is a plan view of the instruction wheel of the kit of FIG. 1.

With reference now to FIG. 6, the instruction wheel 26 aids the golfer in selecting a weight configuration to achieve a desired effect on the trajectory of the golf ball. The instruction wheel provides a graphic, in the form of a trajectory chart 38 on the face of the wheel to aid in this selection. The chart's y-axis corresponds to the height control of the ball's trajectory, generally ranging from low to high. The x-axis corresponds to the directional control of the ball's trajectory, ranging from left to right. In the exemplary embodiment, the chart identifies six different weight configurations 40. Each configuration is plotted as a point on the trajectory chart. Of course, other embodiments can include a different number of configurations, such as, for kits having a different variety of weights. Also, other approaches for presenting instructions to the golfer can be used, for example, charts, tables, booklets, and so on. The six weight configurations of the exemplary embodiment are listed below:

TABLE 1

Weight Configurations for Instruction Wheel

| Config. | | Weight Distribution | | | |
|---|---|---|---|---|---|
| No. | Description | Fwd Toe | Rear Toe | Fwd Heel | Rear Heel |
| 1 | High | 2 g | 10 g | 2 g | 10 g |
| 2 | Low | 10 g | 2 g | 10 g | 2 g |
| 3 | More Left | 2 g | 2 g | 10 g | 10 g |
| 4 | Left | 2 g | 10 g | 10 g | 2 g |
| 5 | Right | 10 g | 2 g | 2 g | 10 g |
| 6 | More Right | 10 g | 10 g | 2 g | 2 g |

Each weight configuration (i.e., 1 through 6) corresponds to a particular effect on launch conditions and, therefore, the golf ball's trajectory. In the first configuration, the CG is in a center-back location, resulting in a high launch angle a relatively low spin-rate for optimal distance. In the second configuration, the CG is in a center-front location, resulting in a lower launch angle and lower spin-rate for optimal control. In the third configuration, the CG is positioned to induce a fade bias. The fade bias is even more pronounced with the fourth configuration. Whereas, in the fifth and sixth configurations, the CG is positioned to induce a draw bias, which is more pronounced in the sixth configuration.

Figures 2, 3, 4, 5:
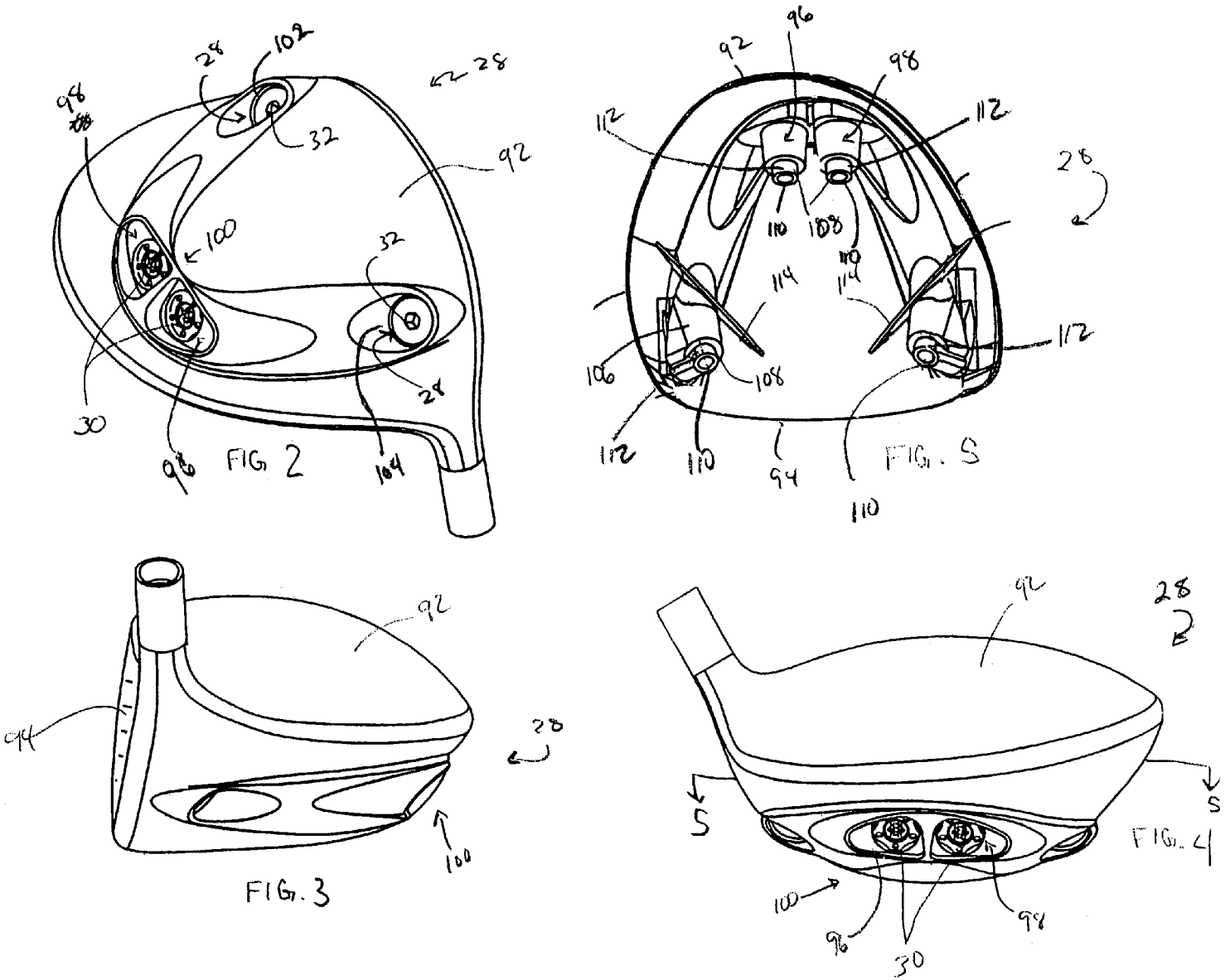
FIG. 2 is a bottom perspective view of a club head having four weight recesses.
FIG. 3 is a side elevational view of the club head of FIG. 2, depicted from the heel side of the club head.
FIG. 4 is a rear elevational view of the club head of FIG. 2.
FIG. 5 is a cross-sectional view of the club head of FIG. 2, taken along line 5-5 of FIG. 4.

In use, the golfer selects, from the various descriptions, the desired effect on the ball's trajectory. For example, if hitting into high wind, the golfer may choose to a low trajectory, (e.g., the second configuration). Or, if the golfer has a tendency to hit the ball right of the intended target, the golfer may choose a weight configuration that encourages the ball's trajectory to left (e.g., the third and fourth configurations). Once the configuration is selected, the golfer rotates the wheel until the desired configuration number is visible in the center window 42. The golfer then reads the weight placement for each of the four locations through windows 48, 50, 52, 54, as shown on the graphical representation 44 of the club head. The description name is also conveniently shown along the outer edge 55 of the wheel 57. For example, in FIG. 5, the wheel displays weight positioning for the "high" trajectory configuration, i.e., the first configuration. In this configuration, two 10-g weights are placed in the rear recesses 96, 98 and two 2-g weights are placed in the forward recesses 102, 104 (FIG. 2). If another configuration is selected, the wheel depicts the corresponding weight distribution, as provided in Table 1, above.

Torque Wrench

With reference now to FIGS. 7-8, the torque wrench 22 includes a grip 54, a shank 56, and a torque-limiting mechanism (not shown). The grip and shank generally form a T-shape; however, other configurations of wrenches can be used. The torque-limiting mechanism is disposed between the grip and the shank, in an intermediate region 58, and it is configured to prevent over-tightening of the weight one of into the recesses (96, 98, 102, 104). In use, once the torque limit is met, the torque-limiting mechanism of the exemplary embodiment will cause the grip to rotationally disengage from the shank. In this manner, the torque wrench inhibits excessive torque on the weight. Preferably, the wrench is limited to between about 20 inch-lbs. and 40 inch-lbs. of torque. More preferably, the limit is between 27 inch-lbs and 33 inch-lbs of torque. In exemplary embodiment, the wrench is limited at about 30 inch-lbs. of torque. Of course, wrenches having various other types of torque-limiting mechanism, or even without such mechanisms, can be used. However, if a torque-limiting mechanism is not used, care should be taken not to over-tighten.

The shank terminates in an engagement end, i.e., tip 60, configured to operatively mate with the fasteners of the weights. The tip includes a bottom wall 62 and a circumferential side wall 64. The head of each of the weights 24 defines a socket 66 having complementary shape to mate with the tip. The side wall of the tip defines a plurality of lobes 68 and flutes 70 spaced about the circumference of the tip. The multi-lobular mating of the tool and the fastener ensures smooth application of torque and minimizes damage to either device (e.g., stripping of tool tip or fastener socket). The bottom wall of the shank 56 defines an axial recess 72 configured to receive a post 74 disposed in the socket of the fastener. The recess is cylindrical and is centered about a longitudinal axis of the shank.

With reference now to FIG. 8, the lobes 68 and flutes 70 are spaced equidistant about the tip 60, in an alternating pattern of six lobes and six flutes. Thus, adjacent lobes are spaced about 60 degrees from each other about the circumference of the tip. In the exemplary embodiment, the tip has an outer diameter ($d_o$), defined by the crests of the lobes, of about 4.50 mm, and trough diameter ($d_t$) defined by the troughs of the flutes, of about 3.30 mm. The axial recess has a diameter ($d_a$) of about 1.10 mm. The socket of the fastener is formed in an alternating pattern of six lobes and six flutes that complements the tip.

Weights

With reference now to FIG. 9, each weight screw 32 has a head 120 and a threaded body 122. The weight screws are formed of titanium, providing a weight that can withstand forces endured upon impacting a golf ball with the club head and yet lightweight. In the exemplary embodiment, the weight screw has an overall length ($L_o$) of about 18.3 mm and is about two grams. In other embodiments, the length and material(s) of the weight screw can be varied to satisfy particular durability and weight requirements. The head is sized to enclose the corresponding weight recess, i.e., 96, 98, 102, 104 (FIG. 2) of the club head 28, such that the periphery of the head generally abuts the side wall of the recess. This helps prevent debris from entering the corresponding recess. Preferably, the head has a diameter ranging between about 11 mm and about 13 mm, corresponding to weight recess diameters of various exemplary embodiments. In this embodiment, the head has a diameter of about 12.3 mm. The head defines a socket 124 having a multi-lobular configuration sized to operatively mate with the wrench tip 60.

The body 122 of the weight screw 32 includes an annular ledge 126 located in an intermediate region thereof. The ledge has a diameter ($d_a$) greater than that of the threaded openings defined in the recesses 96, 98, 102, 104 of the club head 28 (FIG. 2), thereby serving as a stop when the weight screw is tightened. In the embodiment, the annular ledge is distance ($L_a$) of about 11.5 mm from the head 32 and has a diameter ($d_a$) of about 6 mm. The body further includes threads 128 located below the annular ledge. In this embodiment, M5 X 0.6-6 g threads are used. The threaded portion of the body has a diameter ($d_t$) of about 5 mm and is configured to mate with the threaded openings 110 defined in the recesses of the club head.

Figure 10:
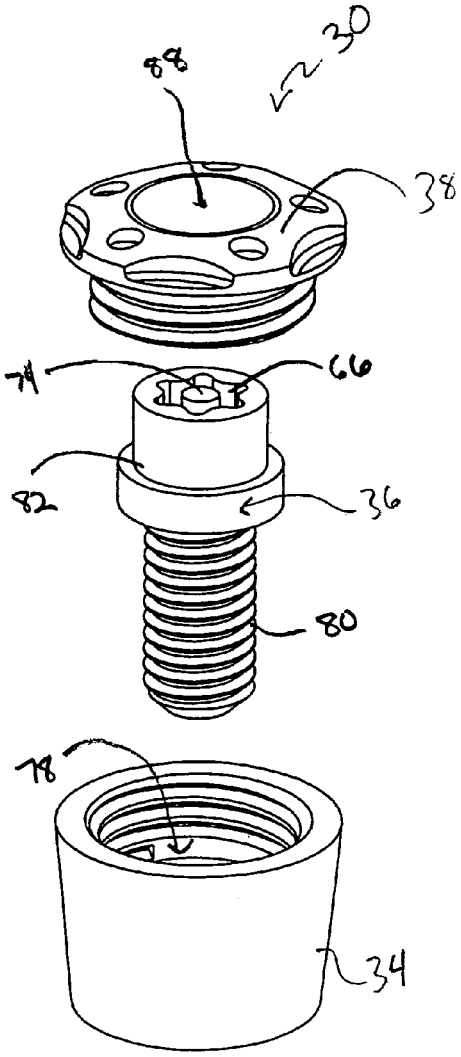
FIG. 10 is an exploded perspective view of a weight assembly of the kit of FIG. 1.
Figure 11:
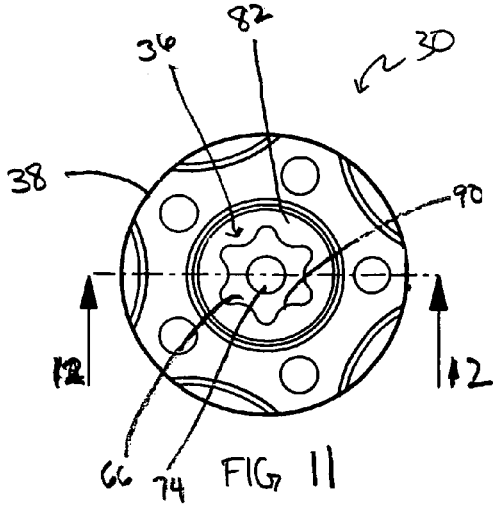
FIG. 11 is a top plan view of the weight assembly of FIG. 9.
Figure 12:
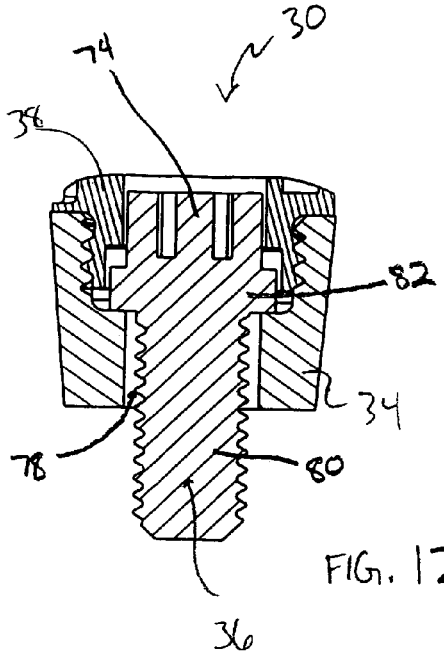
FIG. 12 is a cross-sectional view of the weight assembly of FIG. 9, taken along line 12-12 of FIG. 11.

With reference now to FIGS. 10-12, each mass element 34 of the weight assemblies 30 defines a bore 78 sized to freely receive the screw 36. As shown in FIG. 12, the bore includes a lower non-threaded portion and an upper threaded portion.

The lower portion is sufficiently sized to freely receive a body 80 of the screw, while not allowing the head 82 of the screw to pass. The upper portion of the bore is sufficiently sized to allow the head of the screw to rest therein. More particularly, the head of the screw rests upon a shoulder 84 formed in the bore of the mass element. Also, the upper portion has internal threads 86 for securing the retaining element 38. In constructing the weight assembly, the screw is inserted into the bore of the mass element such that the lower end of the body extends out the lower portion and the head rests within the upper portion. The retaining element is then threaded into the upper end of the mass element, thereby capturing the screw in place. A thread locking compound can be used to secure the retaining element to the mass element.

The retaining element 38 defines an axial opening 88, exposing the socket 66 of the screw head 82 and facilitating engagement of the wrench tip 60 in the socket of the screw. As mentioned above, the side wall of the socket defines six lobes 90 that conform to the flutes 70 (FIG. 8) of the wrench tip. The cylindrical post 74 of the socket is centered about a longitudinal axis of the screw. The post is received in the axial recess 72 (FIG. 8) of the wrench. The post facilitates proper mating of the wrench and the screw, as well as, inhibiting use of a non-compliant tools, such as, Phillips screwdrivers, Allen wrenches, and so on.

Club Head

With reference again to FIGS. 2-5, the club head 28 includes a thin-walled body 92 and a striking face 94. The weights are accessible from the exterior of the club head and securely received into the recesses (96, 98, 102, 104). The weights preferably stay in place via a press fit. They are configured to withstand forces at impact, while also being easy to remove. The four recesses of the club head are positioned low about periphery of the body, providing a low center of gravity and a high moment of inertia. More particularly, first and second recesses 96, 98 are located in a rear region 100 of the club head, and the third and fourth recesses are located in a toe region 102 and a heel region 104 of the club head, respectively. Fewer, such as two or three weights, or more than four weights may be provided as desired.

The recesses 96, 98, 102, 104 are each defined by a recess wall 106 and a recess bottom 108. The recess bottom defines a threaded opening 110 for attachment of the weights. The threaded opening is configured to secure the threaded bodies of the weights. In this embodiment, the threaded bodies of the weights have M5 X 0.6-6 g threads. The threaded opening may be further defined by a boss 112 extending either inward or outward relative to the mass cavity. Preferably, the boss has a length at least half the length of the body of the screw and, more preferably, the boss has a length 1.5 times a diameter of the body of the screw. As depicted in FIG. 5, the boss extends outward, relative to the mass cavity and includes internal threads (not shown). Alternatively, the threaded opening may be formed without a boss.

As depicted in FIG. 3, the club head includes fins 114 disposed about the forward recesses, providing support within the club head and reducing stress on the walls during impact. In this embodiment, the club head has a volume of about 460 cc and a total mass of about 200 g, of which the striking face accounts for about 24 g. As depicted in FIG. 2, the club head is weighted in accordance with the first configuration (i.e., "high") of Table 1, above. With this arrangement, a moment of inertia about a vertical axis at a center of gravity of the club head, $I_{zz}$, is about 405 kg-mm$^2$. Various other designs of club heads and weights may be used, such as those disclosed in Applicant's co-pending application Ser. No. 10/290,817 filed Nov. 8, 2002, which is herein incorporated by reference. Furthermore, yet other club head designs known in the art can be adapted to take advantage of features of the present invention.

To attach a weight assembly in a recess of the club head 28, the threaded body of the screw is positioned against the threaded opening of the recess. With the tip 60 of the wrench inserted through the aperture of the retaining element and engaged in the socket of the screw, the user rotates the wrench 22 to screw the weight assembly in place. Pressure from the engagement of the screw provides a press-fit of the mass element into the recess on the sole, as sides of the mass element slide tightly against the recess side wall. The torque limiting mechanism of the wrench will prevent over-tightening of the weight assembly.

Weight assemblies are also configured for easy removal, if desired. To remove, the user mates the wrench 22 with the weight assembly and unscrews it from the club head. As the user turns the wrench, the head of the screw applies an outward force on the retaining element and thus helps pull out the mass element. Low-friction material can be provided on surfaces of the retaining element and the mass element adjacent to the screw to facilitate free rotation thereof.

It should be appreciated from the foregoing that the present invention provides individual weights and a related kit for adjustably weighting a golf club head, allowing the golfer to fine-tune the club for his or her swing. The kit is useable with a club head that defines a plurality of weight recesses spaced about the club head. The kit includes a plurality of weights, including weights of different mass. Each weight is sized to be threadably received within a recess of the club head. Varying placement of the weights enables a golfer to vary impact conditions in the club head, for optimum distance and accuracy. The kit may further include a tool having an engagement end configured to operatively mate with the fasteners of the weights. The tool preferably includes a torque limiting mechanism configured to inhibit over-tightening of the weights into the recess of the club head. The tool and weights may be provided along with the golf club. The kit may also include instructions, such as an instruction wheel, for selecting and positioning weights of the plurality of weight about the club head.

Although the invention has been disclosed in detail with reference only to the preferred embodiments, those skilled in the art will appreciate that additional golf club heads can be included without departing from the scope of the invention. Accordingly, the invention is defined only by the claims set forth below.

We claim:

1. A kit for adjustably weighting a golf club head, the kit comprising:

a plurality of weights configured to be coupled to the golf club head, wherein at least one of the plurality of weights comprises a head, a body extending from the head, the body having an upper portion, a threaded lower portion, and an annular ledge located in an intermediate region thereof, the annular ledge having a diameter greater than that of a threaded portion of the body, and a mass element located between the head and the annular ledge;

a tool configured to operatively mate with each of the plurality of weights; and instructions for selecting and positioning weights selected from the plurality of weights about the golf club head.

2. The kit of claim 1, wherein the plurality of weights are each configured to be received within a plurality of recesses spaced about the golf club head.

3. The kit of claim 2, wherein the plurality of weights are each configured to be received within four recesses disposed about a periphery of the golf club head.

4. The kit of claim 2, wherein the plurality of weights and the plurality of recesses are configured such that when a weight is disposed within a recess, a peripheral portion of the weight abuts a sidewall of the recess, thereby preventing debris from entering the recess.

5. The kit of claim 1, wherein the plurality of weights includes at least two weights of differing mass.

6. The kit of claim 1, wherein the plurality of weights are configured to be removably coupled to the golf club head.

7. The kit of claim 6, wherein the plurality of weights are configured to be threadably engaged to the golf club head.

8. The kit of claim 1, wherein the plurality of weights includes at least one weight having a mass selected from the group consisting of 2 grams, 6 grams, 14 grams, and 18 grams.

9. The kit of claim 1, wherein the mass of each of the plurality of weights is between 1 gram and 25 grams.

10. The kit of claim 1, wherein the tool includes a torque limiting mechanism.

11. The kit of claim 10, wherein the torque limiting mechanism provides a torque limit of between about 20 inch-lbs. to about 40 inch-lbs.

12. The kit of claim 1, wherein the instructions comprise an instruction wheel having a top member rotatably engaged to a bottom member.

13. A kit for adjustably weighting a golf club head, the golf club head defining four recesses adapted to receive removable weights therein, the kit comprising:

a plurality of weights, each weight configured to be received within a golf club head recess, wherein at least one of the plurality of weights comprises a head, a body extending from the head, the body having an upper portion, a threaded lower portion, and an annular ledge located in an intermediate region thereof, the annular ledge having a diameter greater than that of a threaded portion of the body, and a mass element located between the head and the annular ledge, and wherein the mass of each of the plurality of weights is between 1 gram and 25 grams, and the plurality of weights includes at least two weights of differing mass;

a tool configured to operatively mate with each of the plurality of weights, wherein the tool includes a torque limiting mechanism adapted to provide a torque limit of between about 20 inch-lbs. to about 40 inch-lbs; and instructions for selecting and positioning weights selected from the plurality of weights about the golf club head.

14. A method for adjustably weighting a golf club head, the method comprising:

providing a golf club head;

providing a plurality of weights configured to be coupled to the golf club head, wherein at least one of the plurality of weights comprises a head, a body extending from the head, the body having an upper portion, a threaded lower portion, and an annular ledge located in an intermediate region thereof, the annular ledge having a diameter greater than that of a threaded portion of the body, and a mass element located between the head and the annular ledge;

providing a tool configured to operatively mate with each of the plurality of weights; and providing instructions for selecting and positioning weights selected from the plurality of weights about the golf club head.

15. The method of claim 14, wherein adjustably weighting the golf club head alters the position of a center of gravity of the club head.

16. The method of claim 14, wherein adjustably weighting the golf club head positions the center of gravity of the club head in a center-back location, thereby resulting in a high ball launch angle and a low ball spin-rate.

17. The method of claim 14, wherein adjustably weighting the golf club head positions the center of gravity of the club head in a center-front location, thereby resulting in a low launch angle and a low ball spin-rate.

18. The method of claim 14, wherein adjustably weighting the golf club head results in a draw bias.

19. The method of claim 14, wherein adjustably weighting the golf club head results in a fade bias.

* * * * *